US008073651B2

(12) United States Patent
Abe

(10) Patent No.: US 8,073,651 B2
(45) **Date of Patent: *Dec. 6, 2011**

(54) TIME ACQUISITION APPARATUS AND RADIO WAVE CLOCK

(75) Inventor: Hideo Abe, Tokorozawa (JP)

(73) Assignee: Casio Computer Co., Ltd., Tokyo (JP)

( * ) Notice: Subject to any disclaimer, the term of this patent is extended or adjusted under 35 U.S.C. 154(b) by 345 days.

This patent is subject to a terminal disclaimer.

(21) Appl. No.: 12/414,868

(22) Filed: Mar. 31, 2009

(65) Prior Publication Data

US 2009/0248357 A1 Oct. 1, 2009

(30) Foreign Application Priority Data

Apr. 1, 2008 (JP) ..... 2008-095012

(51) Int. Cl.
*G04C 11/02* (2006.01)

(52) U.S. Cl. ..... 702/178

(58) Field of Classification Search ..... 702/178
See application file for complete search history.

(56) References Cited

U.S. PATENT DOCUMENTS

2005/0195690 A1 9/2005 Kondo
2011/0075522 A1* 3/2011 Abe et al. ..... 368/47

* cited by examiner

*Primary Examiner* — Tung S Lau

(74) *Attorney, Agent, or Firm* — Holtz, Holtz, Goodman & Chick, PC

(57) ABSTRACT

A received waveform memory 22 stores one (1) frame of received waveform data acquired by sampling a signal including a time code with a predetermined sampling period, where each sample is represented by a plurality of bits. Correlation value calculating sections 24-26 compare the received waveform data with one (1) frame of first prediction code data corresponding to a code of a position marker or a marker, where each sample is represented by a plurality of bits, one (1) frame of second prediction code data corresponding to a code "0", and one (1) frame of third prediction code data corresponding to a code "1" respectively. Correlation value comparing section 27 compares the first, second and third correlation values with one another to specify the prediction code data whose correlation is largest to output the code data.

10 Claims, 10 Drawing Sheets

TIME ACQUISITION APPARATUS AND RADIO WAVE CLOCK

CROSS-REFERENCE TO RELATED APPLICATIONS

This application is based upon and claims the benefit of priority from the prior Japanese Patent Application No. 2008-95012 filed on Apr. 1, 2008, the entire contents of which are incorporated herein by reference.

BACKGROUND OF THE INVENTION

1. Field of the Invention

The present invention relates to a time acquisition apparatus to acquire current time using standard radio wave and a radio wave clock on which the time acquisition apparatus is mounted.

2. Description of Related Art

Currently, a long-wave standard time radio wave is transmitted from transmitting stations in various countries such as Japan, Germany, England and Switzerland For example, in Japan, the standard time radio waves of 40 kHz and 60 kHz that have been subjected to amplitude modulation are respectively transmitted from transmitting stations in Hukushima prefecture and Saga prefecture.

The standard time radio wave includes a code sequence which constructs a time code indicating date and time, and is sent in 60 seconds per period. In other words, the period of the time code is 60 seconds.

A clock (radio wave clock) which receives such standard time radio wave including the time code to extract the time code from the received standard time radio wave so as to correct time has been put to practical use.

A receiving circuit of the radio wave clock includes: a band path filter (BPF) to receive the standard time radio wave received by an antenna to extract only a standard time radio wave signal; a demodulating circuit to demodulate the standard time radio wave signal that has been subjected to amplitude modulation by envelope detection and the like; and a processing circuit to read out the time code included in the signal demodulated by the demodulating circuit.

A conventional processing circuit synchronizes a starting point of a timekeeping period for data discrimination with a rising edge of the demodulated signal, and then binarizes the demodulated signal with a predetermined sampling period to acquire TCO data which is a binary bit sequence. Moreover, the processing circuit measures a pulse width (namely, a time of bit "1", or a time of bit "0") of the TCO data to determine any one of code "P", "0" and "1" according to the width size so as to acquire time information based on determined code sequence.

The conventional processing circuit passes through processes including a second bit synchronization processing, a minute bit synchronization processing, code loading, and consistency judging, from starting reception of the standard time radio wave to acquiring the time information When processing is not properly completed in each of the processes, the processing circuit needs to start the processing again from the beginning.

Thus, the processing sometimes needs to be started again many times due to noise included in the signal, and time to acquisition of the time information sometimes becomes seriously long.

The second bit synchronization is to detect a rising edge of the code which comes per one (1) second among the code indicated by the TCO data. By repeating the second bit synchronization, a portion where a position marker "P0" provided at ending of a frame and a marker "M" provided at beginning of the frame are located consecutively can be detected. This consecutive portion comes every one (1) minute (60 seconds). A position of the marker "M" locates in data of the beginning frame among the TCO data. Detecting the marker "M" is hereinafter called the minute bit synchronization.

Since the beginning of the frame is recognized by the above-described minute bit synchronization, then the code loading is started, and after one (1) frame of data is obtained, a parity bit is examined to judge whether or not the data has impossible value (value which can not be real data and time) (the consistency judging). For example, the minute bit synchronization sometimes requires 60 seconds for finding the beginning of the frame. Of course it requires several fold longer time than above time in order to detect the beginning of the frame across several frames.

In US2005/0195690A1, the TCO data is obtained by binarizing the demodulated signal at predetermined sampling intervals (50 ms), and data constellation composed of binary bit sequences is listed, each of the binary bit sequences corresponding to one (1) second (20 samples).

An apparatus disclosed in US2005/0195690A1 compares above bit sequence with a template of the binary bit sequence indicating code "P: position marker", a template of the binary bit sequence indicating code "1", and a template of the binary bit sequence indicating code "0" respectively, to obtain their correlation, and judges which of codes "P", "1" and "0" the bit sequence corresponds to, based on the correlation.

A technique disclosed in US2005/0195690A1 acquires the TOC data which is the binary bit sequence to perform matching with the template. Under a condition that electric field intensity is weak or that much noise is mixed into the demodulated signal, the acquired TCO data would include many errors. Therefore, it was necessary to fine-adjust a threshold of a filter for removing noise from the demodulated signal or an AD converter so as to improve quality of the TCO data.

SUMMARY OF THE INVENTION

An object of the present invention is to provide a time acquisition apparatus capable of properly obtaining a code included in standard time radio wave to acquire current time without being influenced by a status of electric filed intensity or noise in a signal, and to provide a radio wave clock provided with the time acquisition apparatus.

The object of the present invention is achieved by a time acquisition apparatus including: a receiving member to receive a standard time radio wave; a received waveform data obtaining member to perform sampling to a signal including a time code output from the receiving member with a predetermined sampling period to obtain one frame of received waveform data where each sample has a value represented by a plurality of bits; a received waveform data memory to store the received waveform data; a prediction code data generating member to generate one frame of first prediction code data corresponding to a code of a position marker or a marker, in which data each sample has a value represented by a plurality of bits, one frame of second prediction code data corresponding to a code "0", and one frame of third prediction code data corresponding to a code "1", a correlation value calculating member to compare the one frame of the received waveform data stored in the received waveform data memory with the first prediction code data, the second prediction code data and the third prediction code data respectively, to calculates a first correlation value, a second correlation value and a third correlation value which indicate correlations between the received waveform data and the first, second, and third prediction code data; a code determining member to compare the first, second, and third correlation value with one another to specify the prediction code data corresponding to the largest correlation value, and to sequentially store codes corresponding to the specified prediction code data in a code memory; and a current time calculating member to calculate current time based on the time code indicated by the code, with reference to the code sequence stored in the code memory.

Moreover, the object of the present invention is achieved by a radio wave clock including: the time acquisition apparatus; an internal timekeeping member to keep current time by an internal clock; a time correcting member to correct time kept by the internal timekeeping member according to current time acquired by the time acquisition apparatus; and a time displaying member to display the current time which is kept by the internal timekeeping member or corrected by the time correcting member.

BRIEF DESCRIPTION OF THE DRAWINGS

The present invention will sufficiently be understood by the following detailed description and accompanying drawing, but they are provided for illustration only, and not for limiting the scope of the invention.

DETAILED DESCRIPTION OF THE PREFERRED EMBODIMENTS

In the following, the embodiment of the present invention will be described with reference to the drawings. In the embodiment of the present invention, a time acquisition apparatus of the present invention is provided in a radio wave clock which receives a standard time radio wave in a long wave band, detects the signal, and extracts a code sequence indicating a time code included in the signal to correct time based on the code sequence.

Presently, in Japan, Germany, England, Switzerland and the like, the standard time radio wave has been transmitted from a predetermined transmitting station. For example, in Japan, the standard time radio waves of 40 kHz and 60 kHz that have been subjected to amplitude modulation are respectively transmitted from transmitting stations in Hukushima prefecture and Saga prefecture. The standard time radio wave includes a code sequence which constructs a time code indicating date and time, and is sent in 60 seconds per period.

Figure 1:
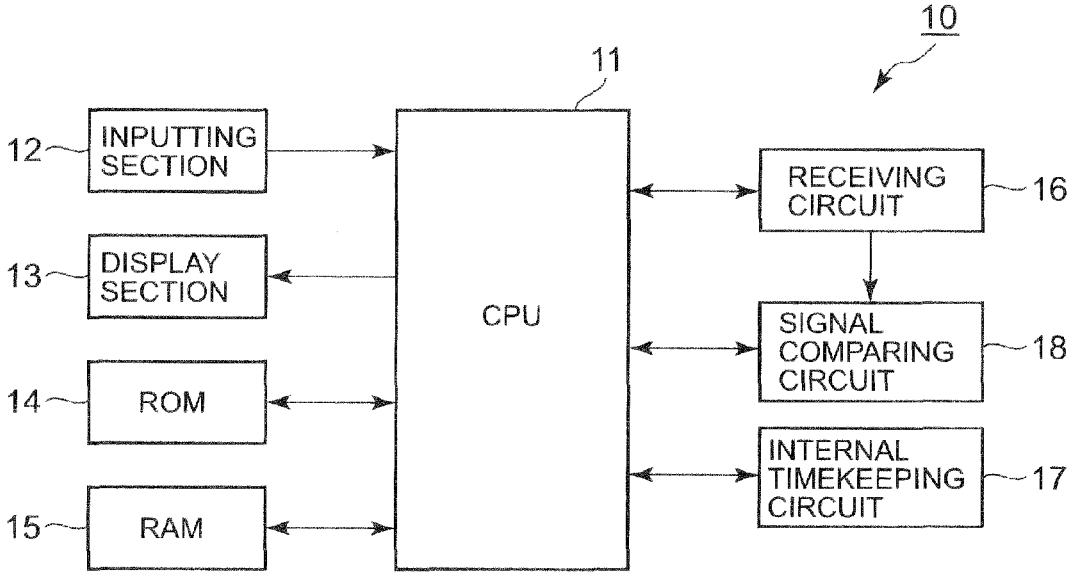
FIG. 1 is a block diagram showing a configuration of a radio wave clock according to a present embodiment.

FIG. 1 is a block diagram showing a configuration of the radio wave clock according to the embodiment. As shown in FIG. 1, a radio wave clock 10 includes: a CPU 11; an inputting section 12: a display section 13; a ROM14; a RAM 15; a receiving circuit 16; an internal timekeeping circuit 17; and a signal comparing circuit 18.

The CPU 11 performs a processing such as transferring an instruction to each section of the radio wave clock 10, data, and so on, at predetermined timing or based on a program which is stored in the ROM 14 and read out by the CPU 11 according to an operation signal input from the inputting section 12 to be expanded in the RAM 15.

Specifically, for example, the CPU 11 performs a processing including controlling the receiving circuit 16 to receive the standard time radio wave every predetermined period, specifying the code sequence included in a standard radio wave signal, and correcting current time kept by the internal timekeeping circuit 17 based on the code sequence, or a processing including transferring current time kept by the internal timekeeping circuit 17 to the display section 13.

In the embodiment, the TOC data which is so-called binary bit sequence is not obtained, but the codes indicating "p: position marker", "1" and "0" are obtained for calculating accurate current time based on the code sequence, and the error in the internal timekeeping circuit 17 is calculated for correcting current time in the internal timekeeping circuit 17.

The inputting section 12 includes a switch for instructing to perform various functions of the radio wave clock 10, and when the switch is operated, a corresponding operation signal is output to the CPU 11.

The display section 13 includes a dial window, an analog pointer mechanism controlled by the CPU 11, and a liquid crystal panel, and displays current time kept by the internal timekeeping circuit 17.

The ROM 14 allows the radio wave clock 10 to operate, and stores a system program and an application program for realizing a predetermined function, and so on.

The RAM 15 is used as a work area of the CPU 11, and temporally stores a program and data read from the ROM 14, data processed by the CPU 11, and so on.

The receiving circuit 16 includes an antenna circuit, a detecting circuit and the like, and obtains a demodulated signal from the standard time radio wave received by the antenna circuit to output the signal to the signal comparing circuit 18. The internal timekeeping circuit 17 includes an oscillation circuit, counts a clock signal output from the oscillation circuit to keep current time, and outputs the current time data to the CPU 11.

Figure 2:
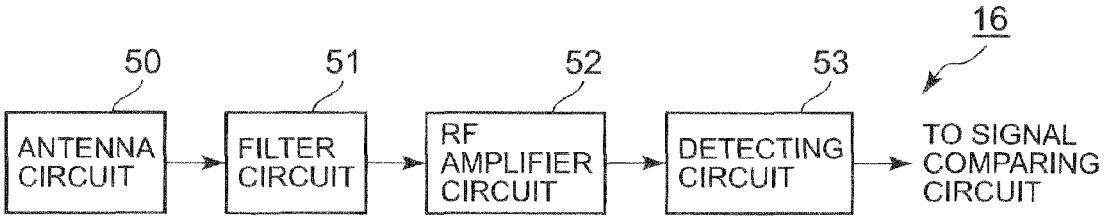
FIG. 2 is a block diagram showing a configuration example of a receiving circuit according to the present embodiment.

FIG. 2 is a block diagram showing a configuration example of the receiving circuit according to the embodiment.

As shown in FIG. 2, the receiving circuit 16 includes: an antenna circuit 50 to receive the standard time radio wave; a filter circuit 51 to remove noise of a signal (standard time radio wave signal) of the standard time radio wave received by the antenna circuit 50; an RF amplifier circuit 52 to amplify high frequency signal which is an output of the filter circuit 51; and a detecting circuit 53 to detect the signal output from the RF amplifier circuit 52 to demodulate the standard time radio wave signal, and the signal demodulated by the detecting circuit 53 is output to the signal comparing section 18.

Figure 3:
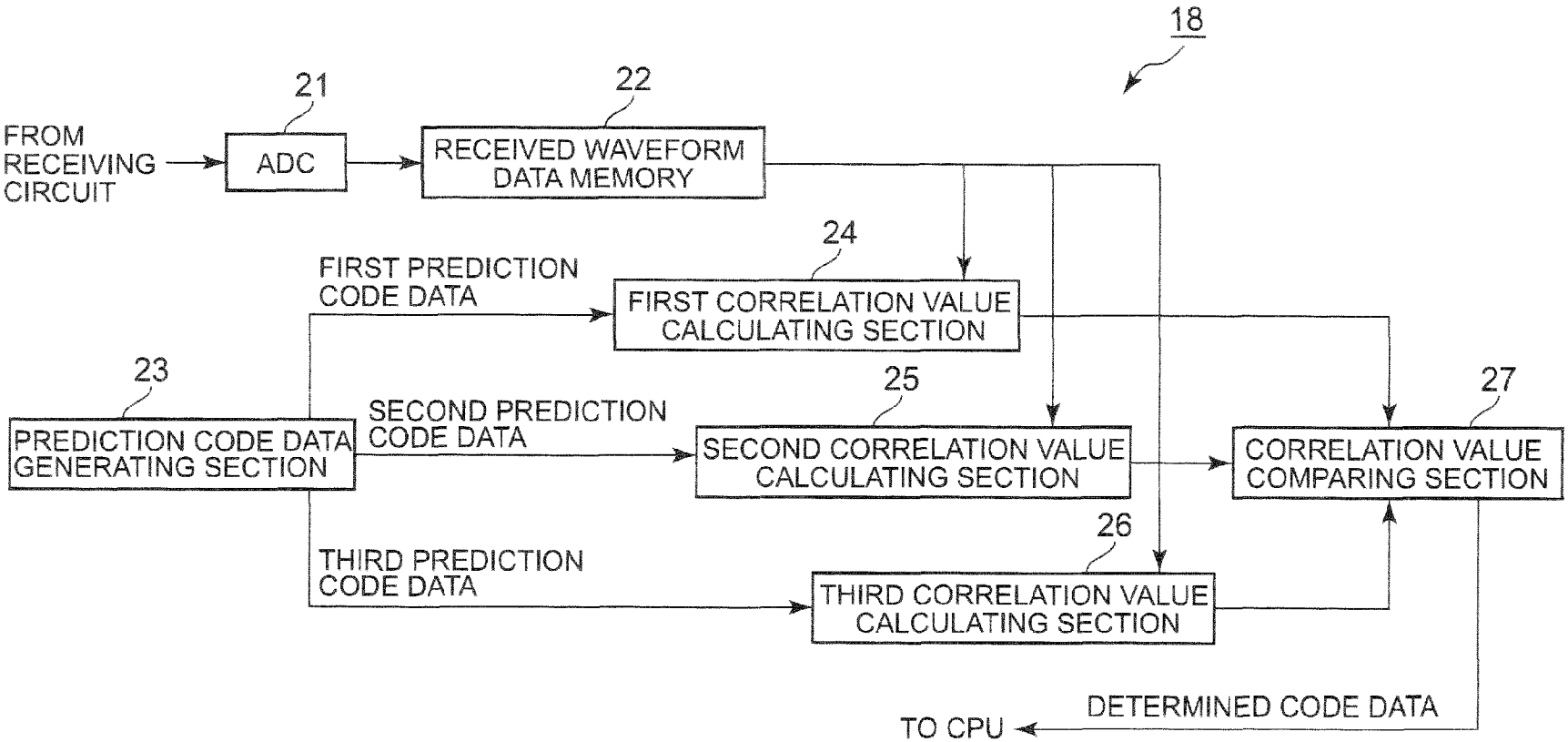
FIG. 3 is a block diagram showing a configuration of a signal comparing circuit according to the present embodiment.

FIG. 3 is a block diagram showing a configuration of the signal comparing circuit according to the embodiment.

As shown in FIG. 3, the signal comparing section 18 according to the embodiment includes: an AD converter (ADC) 21; a received waveform memory 22; a prediction code data generating section 23; a first correlation value calculating section 24; a second correlation value calculating section 25; a third correlation value calculating section 26; and a correlation value comparing section 27.

The ADC 21 converts the signal output from the receiving circuit into digital data whose value is represented by a plurality of bits at predetermined sampling intervals to output the digital data. The received waveform data memory 22 sequentially extracts the received waveform data having data length corresponding to one (1) frame from the digital data, and stores these received waveform data.

Figures 4A, 4B, 4C, 4D:
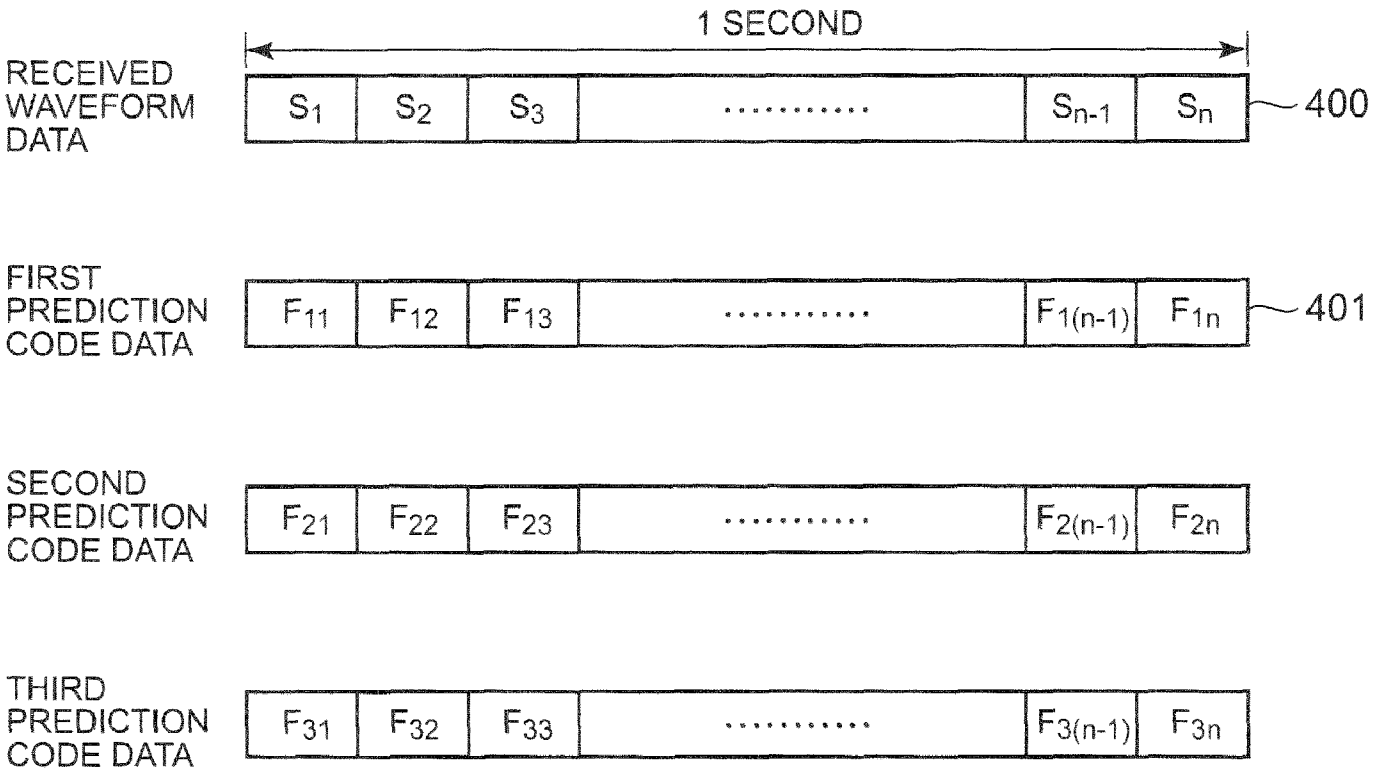
FIG. 4A is a diagram showing configuration examples of received waveform data and prediction code data.
FIG. 4B is a diagram showing configuration examples of received waveform data and prediction code data.
FIG. 4C is a diagram showing configuration examples of received waveform data and prediction code data.
FIG. 4D is a diagram showing configuration examples of received waveform data and prediction code data.

In the embodiment, the sampling period of the digital data is 50 ms. Moreover, as shown in FIG. 4A, the data length of the received waveform data 400 is one (1) second (20 samples). In the embodiment, one (1) sample ($S_1$, $S_2$, $S_3$, . . . , $S_n$) of the received waveform data is 8 bits.

The prediction code data generating section 23 outputs a first prediction code data having a data length corresponding to one (1) frame, whose duty is 20 percent, and which corresponds to the code "P: position marker", a second prediction code data having a data length corresponding to one (1) frame, whose duty is 50 percent, and which corresponds to the code "1", and a third prediction code data having a data length corresponding to one (1) frame, whose duty is 80 percent, and which corresponds to the code "0".

Also, as regards the first prediction code data, the second prediction code data and the third prediction code data, the sampling period is 50 ms, the data length is one (1) second (20 samples), bit number per one (1) sample (for example, $F_{11}$, $F_{12}$, $F_{13}$, $F_{21}$, $F_{22}$, $F_{23}$, $F_{31}$, $F_{32}$, $F_{33}$: see FIGS. 4B to 4D) is 8 bits.

The prediction code data generating section 23 may read out the prediction code data previously stored in the ROM 14 or the RAM 15. Alternatively, the prediction code data generating section 23 may be constructed so as to calculate the value represented by a plurality of bits for each of the samples with a certain sampling period.

Each of the first correlation value calculating section 24, the second correlation value calculating section 25 and the third correlation value calculating section 26 compares each of the first prediction code data, the second prediction code data and the third prediction code data with the corresponding sample of the received waveform data to calculate the correlation value between each of the first prediction code data, the second prediction code data and the third prediction code data, and the received waveform data.

The correlation value comparing section 27 compares the correlation values output from the first correlation value calculating section 24, the second correlation value calculating section 25 and the third correlation value calculating section 26, with one another, determines the code indicated by the received waveform data, and outputs data (determined code data) indicating the determined code to the CPU 11.

Figure 5:
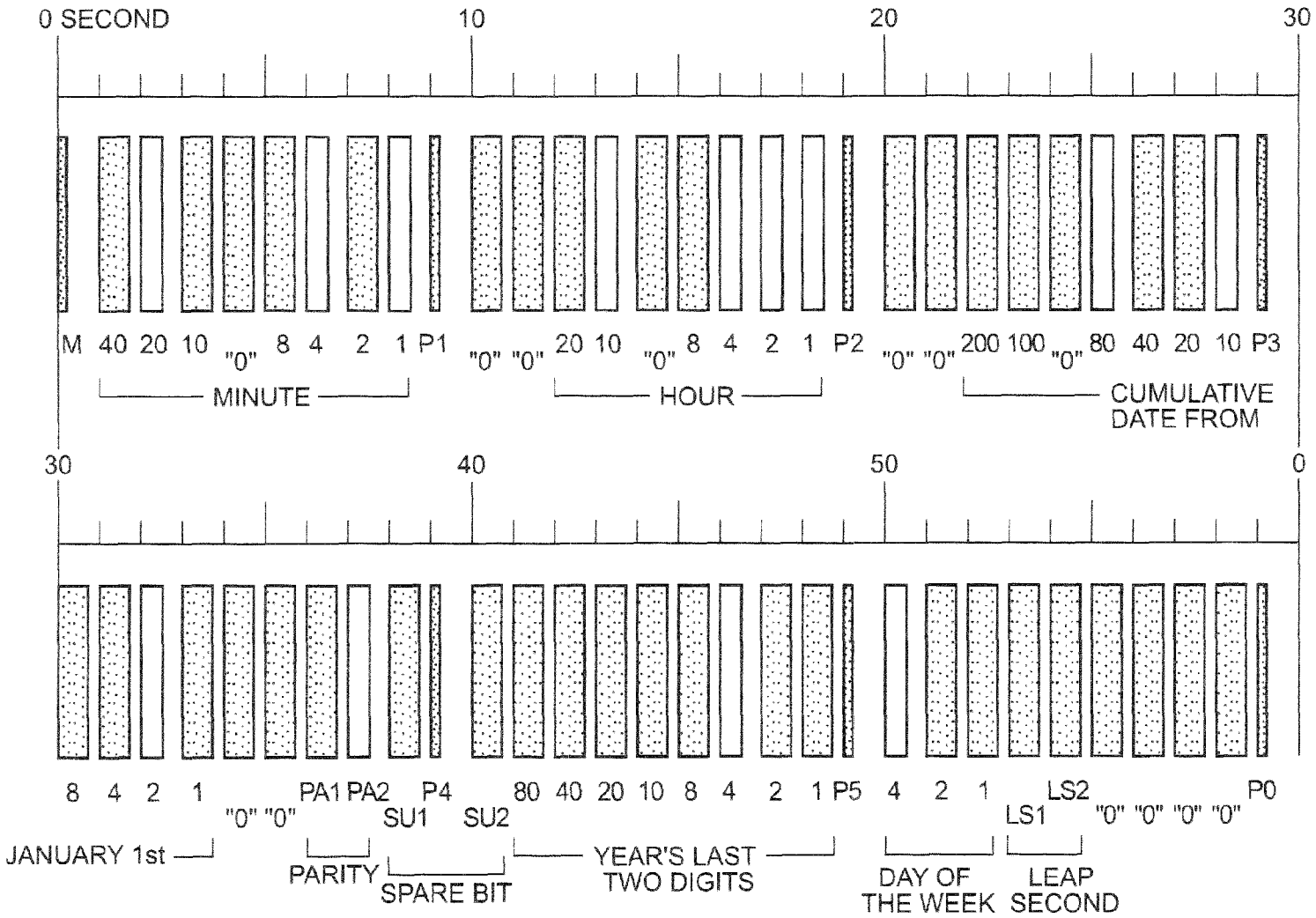
FIG. 5 is a diagram showing an example of a standard radio wave signal.

As shown in FIG. 5, the standard time radio wave signal is transmitted in a predetermined format. In the standard time radio wave signal, the codes are located sequentially, each of the codes corresponding to one (1) second and indicating "P", "1" or "0". One (1) frame of the standard time radio wave corresponds to 60 seconds, thus one (1) frame includes 60 codes.

Moreover, in the standard time radio wave, position marker "P1", "P2", . . . or marker "M" comes every 10 seconds, and by detecting the portion where the position marker "P0" provided in ending of the frame and the marker "M" provided in beginning of the frame are located consecutively, a head of the frame which comes every 60 seconds can be found. The received waveform data shown in FIG. 4A, and the first prediction code data, the second prediction code data and the third prediction code data which are shown in FIGS. 4B-4D have data lengths same as the code corresponding to one (1) second.

Figure 6:
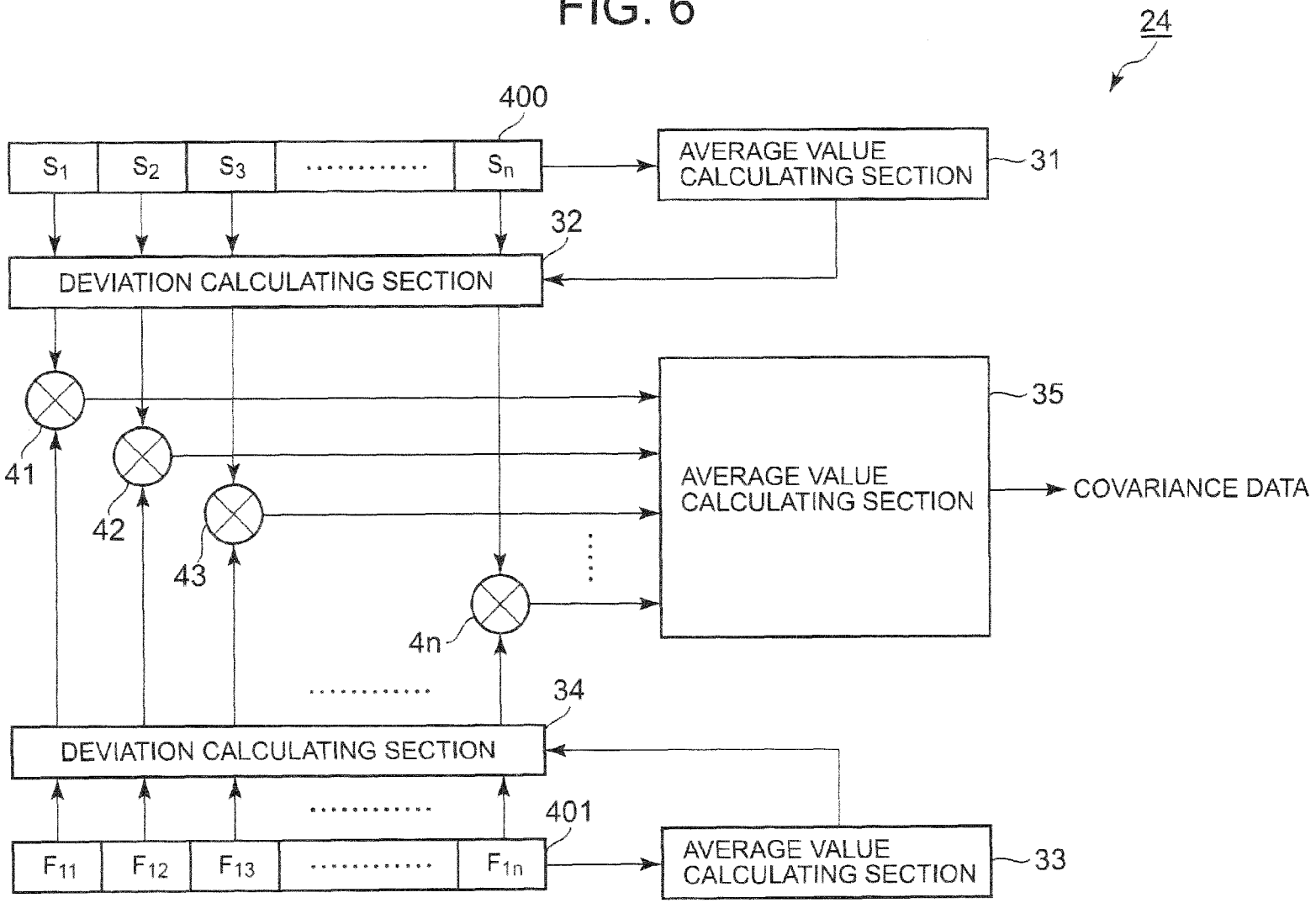
FIG. 6 is a block diagram showing details of a correlation value calculating section according to the present embodiment.

FIG. 6 is a block diagram showing details of the correlation value calculating section according to the embodiment. As regards FIG. 6, though only the first correlation value calculating section 24 will be explained, the second correlation value calculating section 25 and the third correlation value calculating section 26 have same configurations as that of the first correlation value calculating section 24.

As shown in FIG. 6, the first correlation value calculating section 24 includes: an average value calculating section 31 to calculate an average value of the samples of the received waveform data 400; a deviation calculating section 32 to calculate a deviation between each of the samples of the received waveform data 400 and an average value of the samples; an average value calculating section 33 to calculate an average value of the samples of the first prediction code data 401; a deviation calculating section 34 to calculate a deviation between each of the samples of the first prediction code data 401 and an average value of the samples; a plurality of multipliers 41, 42, . . . , **4*n* to multiply the deviation of the sample of the received waveform data by the deviation of corresponding sample of the first prediction code data; and an average value calculating section 35** to calculate an average value of multiplication values (product of the deviations) output from the multipliers.

The correlation value calculating section 24 shown in FIG. 6 calculates an average value of the product of the deviations from the average, namely a covariance. The larger the correlation of the data, the larger the covariance. The covariance data is output from the correlation value calculating section 24.

Hereinafter, a processing to be executed in the radio wave clock having above-described configuration will be explained.

Figure 7:
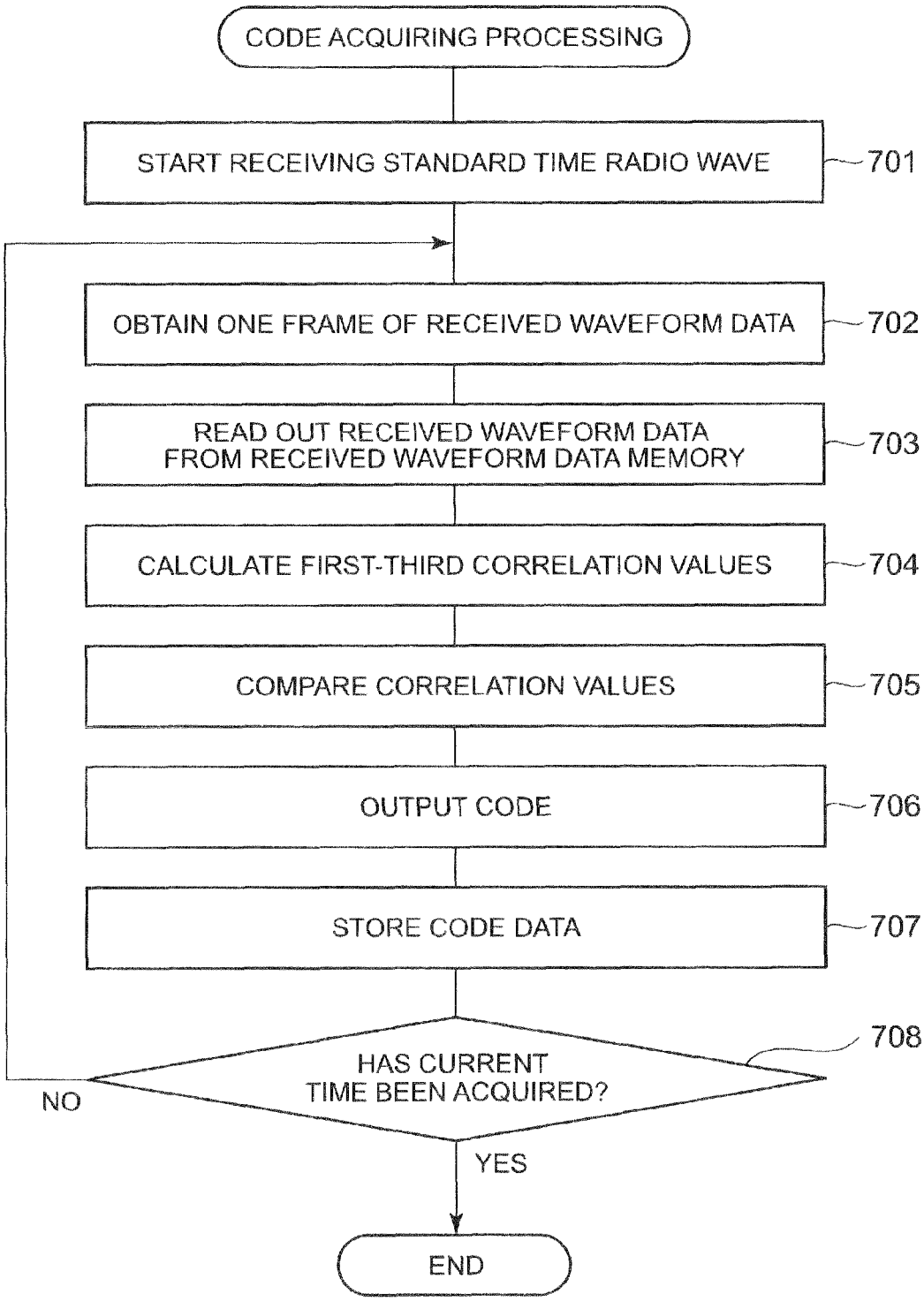
FIG. 7 is a flowchart showing an example of a code acquiring processing to be executed in the radio wave clock according to the present embodiment.

FIG. 7 is a flowchart showing an example of a code acquiring processing to be executed in the radio wave clock according to the embodiment.

In the embodiment, the receiving circuit 16 starts to receive the standard time radio wave at a constant timing or by an operation on the inputting section 12 by a user of the radio wave clock 10 (Step 701). The receiving circuit 16 performs necessary processing such as removing the noise of the standard time radio wave received by the antenna circuit 50 and detecting the standard time radio wave, and outputs the demodulated signal.

In the signal comparing circuit 18, the demodulated signal is received, the ADC 21 performs digital conversion to the signal, and one (1) frame of the received waveform data is obtained to be stored in the received waveform data memory 22 (Step 702). For example, initially, the rising edge of the demodulated signal is captured, and by using the rising edge as a trigger, one (1) second (one (1) frame) of the received wave form data is obtained to be stored in the received waveform data memory 22. After that, every time one (1) second of the sample is obtained, it may be stored in the received waveform data memory 22 as the received waveform data.

With regards to the rising edge of the signal, in a state of an analog signal, by detecting a level of the signal, the signal when the level of the signal exceeds a threshold level during a predetermined time or more may be judged as the rising edge of the signal. Alternatively, by monitoring an output of the ADC 21, the signal when the sample value exceeds a threshold level during a predetermined time or more may be judged as the rising edge of the signal.

Moreover, since obtaining one (1) frame of the received waveform data is continued to be executed, even during executing Steps 703-708, next one (1) frame of the received waveform data is obtained, and the obtained received waveform data is stored in the received waveform data 22.

Each of the first correlation value calculating section 24, the second correlation value calculating section 25 and the third correlation value calculating section 26 reads out one (1) frame of the received waveform data from the received waveform data 22 (Step 703), and calculates the first correlation value, the second correlation value and the third correlation value respectively (Step 704).

For example, the average value calculating section 31 of the first correlation value calculating section 24 calculates the average value $S_{ave}$ of the samples $S_1, S_2, S_3, \ldots, S_n$ of the received waveform data 400. The deviation calculating section 32 calculates the deviations $S'_1, S'_2, S'_3, \ldots, S'_n$ between each of the samples $S_1, S_2, S_3, \ldots, S_n$ and the average value $S_{ave}$.

Moreover, the average value calculating section 33 calculates the average value $F_{ave1}$ of the samples $F_{11}, F_{12}, F_{13}, \ldots, F_{1n}$ of the prediction code data 401. The deviation calculating section 34 calculates the deviations $F'_{11}, F'_{12}, F'_{13}, \ldots, F'_{1n}$ in between each of the samples $F_{11}, F_{12}, F_{13}, \ldots, F_{1n}$ and the average value $F_{ave1}$. The multipliers 41-4*n* multiply the deviations of $S'_1, S'_2, S'_3, \ldots, S'_n$ of the samples of the received waveform data by the corresponding deviations $F'_{11}, F'_{12}, F'_{13}, \ldots, F'_{1n}$ of the samples of the prediction code data to obtain the multiplication values $S'_1 \times F'_{11}, S'_2 \times F'_{12}, S'_3 \times F'_{13}, \ldots, S'_n \times F'_{1n}$ respectively.

The average value calculating section 35 calculates the average value of the multiplication values, $(S \times F)_{ave} = (1/n) \times \Sigma S'_k \times F'_{1K}$ (k=1, 2, . . . , n). The correlation value (covariance data) obtained in this way is output to the correlation value comparing section 27.

The correlation value comparing section 27 compares the first correlation value, the second correlation value and the third correlation value respectively calculated by the first correlation value calculating section 24, the first correlation value calculating section 25 and the third correlation value calculating section 26, with one another, to specify the largest correlation value (Step 706).

The correlation value comparing section 27 outputs the code corresponding to the prediction code data which is the basis of the largest correlation value, as the determined code data corresponding to one (1) frame of the received waveform data which has been subjected to the processing (Step 706).

The CPU 11 stores the received code data in a predetermined region of the RAM 15 (Step 707).

Obtaining one (1) frame of the received waveform data (Step 702) and storing the code data (Step 707) are repeated until current time is finally acquired (Step 708: Yes).

Thus, the plural pieces of code data each corresponding to one (1) frame are obtained sequentially to be stored in the RAM 15. Therefore, the CPU 11 can perform the processing for calculating current time with reference to the code sequence stored in a predetermined region of the RAM 15.

Figure 8:
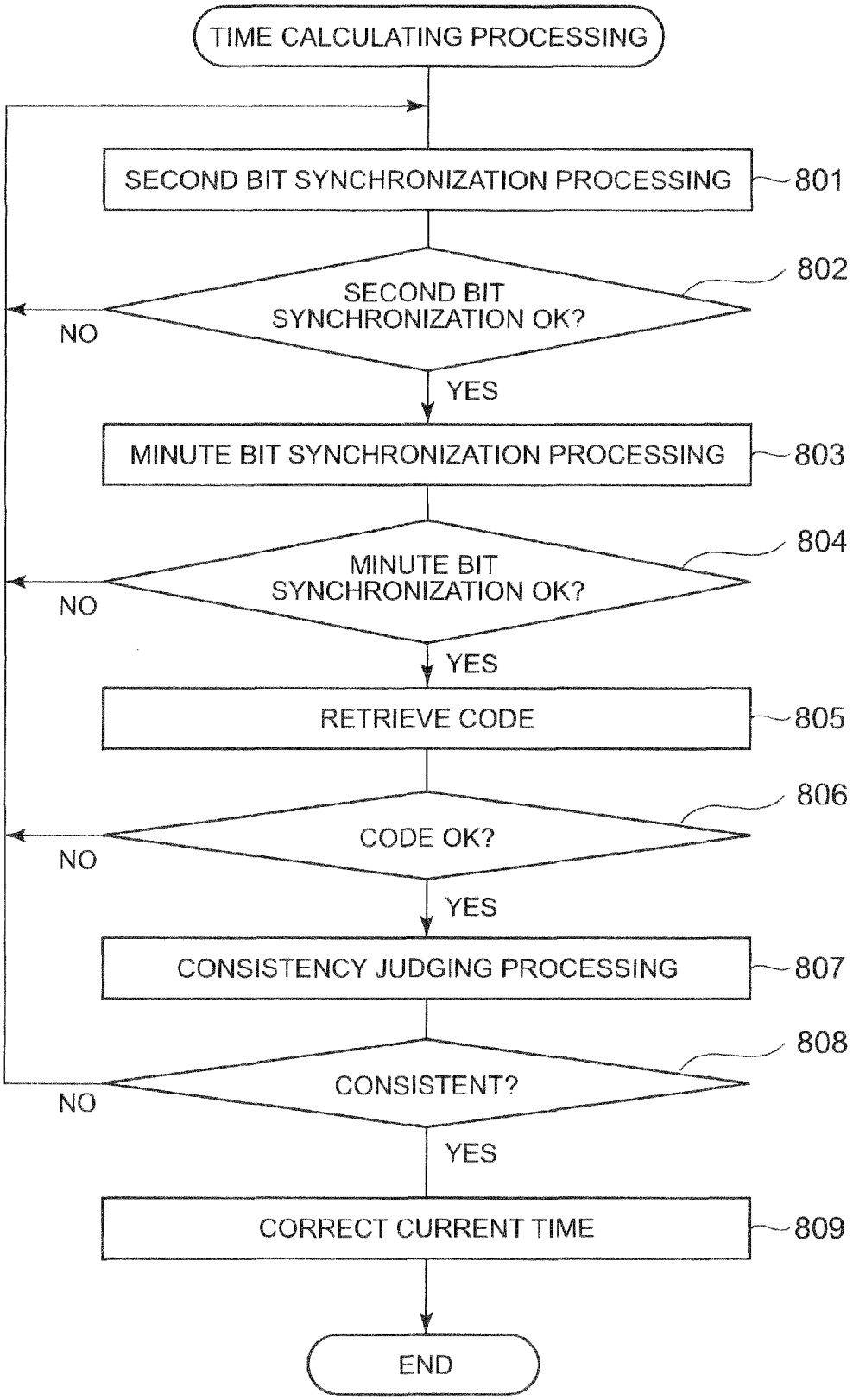
FIG. 8 is a flowchart showing an example of a time calculating processing according to the present embodiment.

FIG. 8 is a flowchart showing an example of a time calculating processing according to the embodiment.

As shown in FIG. 8, the CPU 11 reads out the code data stored in the RAM 15 to perform the second bit synchronization processing (Step 801). In the second bit synchronization processing, the CPU 11 judges which of the codes "P", "0" and "1" the code data represents, and judges whether or not the code indicating "P" exists in every 10 codes.

As a result of above judgment, when the code has been captured properly (Step 802; Yes), the CPU 11 performs minute bit synchronization processing (Step 803).

In the minute bit synchronization processing, the CPU 11 judges that the code data indicating the position marker "P0" provided in ending of the frame and the code data indicating the marker "M" provided in beginning of the frame are located consecutively. In other words, the CPU 11 judges that the codes indicating "P" are located consecutively. Moreover, the CPU 11 judges whether or not the consecution of the codes indicating "P" exists in every 60 frames.

As a result of above judgment, when the position marker and the marker are properly located consecutively (Step 804; Yes), the CPU 11 recognizes the marker located subsequently to the position marker as the head of the code data stored in the RAM 15 to retrieve 60 code data (Step 806).

When the code data can be retrieved (Step 806; Yes), the CPU 11 executes a consistency judging processing (Step 807) to judge whether or not the date and time acquired from the retrieved data match up to reality.

When the CPU 11 judges that the retrieved code has a consistency (Step; 808), the CPU 11 corrects current time kept by the internal timekeeping circuit 17 based on the current time acquired from the retrieved code, and displays the acquired current time on the display section 13 (Step 809).

As described above, in the embodiment, the correlation value between one (1) frame of the received waveform data where each of the samples has the value represented by a plurality of bits and one (1) frame of the prediction code data corresponding to each of the code, in which data each of the samples has the value represented by a plurality of bits is calculated, the prediction code data whose correlation is largest is specified, and the code corresponding to the specified prediction code data is obtained.

By obtaining the codes sequentially, each corresponding to the frame, the code sequence can be obtained. The current time can be calculated based on the code sequence. Since the correlation value is calculated by using the sample whose value is represented by a plurality of bits, a status of electric field intensity and a noise influence can be reduced in the calculation of the correlation value. As result, it becomes possible to obtain the code with high accuracy.

Moreover, in the embodiment, the code sequence can be obtained without obtaining the TCO data as the binary bit sequence. Although it has been necessary to fine adjust a constant value of the filter or a threshold value of the AD converter when obtaining the TCO data, such fine adjustment becomes unnecessary according to the embodiment.

Furthermore, in the embodiment, the deviation between the average value of the sample values of the received waveform data and each of the sample values of the received waveform data, and the deviation between the average value of the sample values of any pieces of the predicted code data and each of the sample values of any pieces of the predicted code data are calculated, and the covariance acquired by averaging the multiplication value of the deviations is set as the correlation value.

The covariance has a characteristic such that it is a function to capture whole shape of the waveform to quantify the shape. Therefore, when whole shape of the waveform is kept at recognizable level, the covariance is less influenced by random noise or unexpected noise. Thus, it becomes possible to realize code regeneration which is resistant to noise.

Next, the prediction code data according to the embodiment will be described. Since the prediction code data represents predetermined duty ratio (2:8 (20 percent), 5:5 (50 percent), 8:2 (80 percent)), when an ideal value is adapted, according to the duty ratio, the prediction code data becomes the sample value where all of the bits are "1" or the sample value where all of the bits are "0".

Figure 9A:
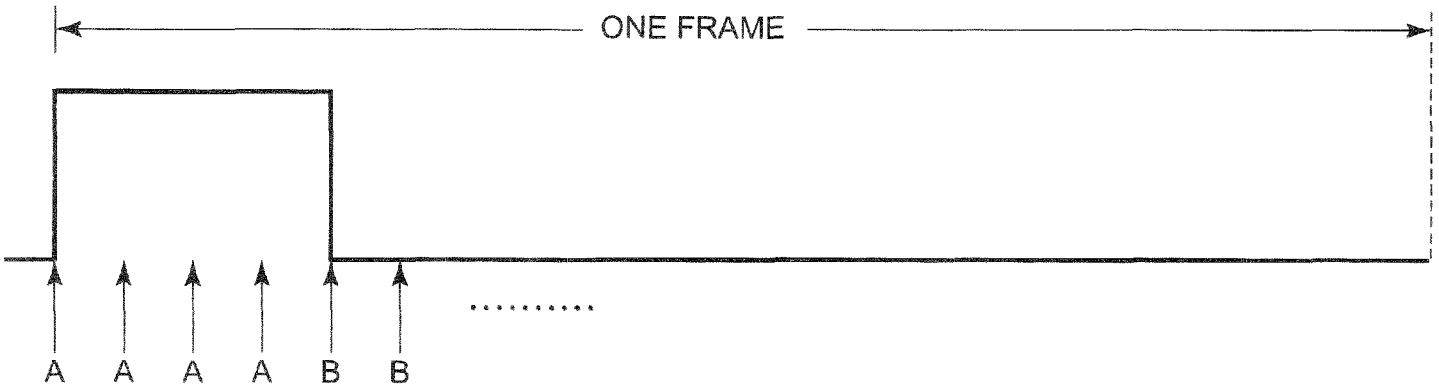
FIG. 9A is a diagram showing an example of the prediction code data according to the present embodiment.

FIG. 9A is a diagram showing an example of the prediction code data corresponding to the code "P; position marker". In FIG. 9A, the prediction code data instantly changes from a low level to a high level without passing through a transient state. Therefore, the sample value becomes A (the value where all of the bits are "1") or B (the value where all of the bits are "0").

However, since an actual signal includes a noise and has passed through the filter for removing such noise, the transient state where the sample value becomes an intermediate value would be included between the low level and the high level. Therefore, in the embodiment, the prediction code data may includes the intermediate value corresponding to the transient state between the low level and the high level.

Figure 9B:
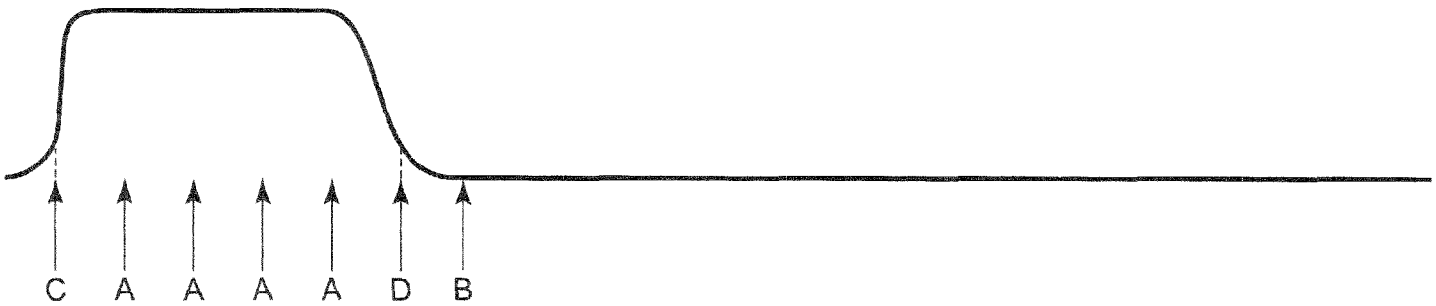
FIG. 9B is a diagram showing an example of the prediction code data according to the present embodiment.

FIG. 9B is a diagram showing another example of the prediction code data corresponding to the code "P: position marker". In FIG. 9B, the prediction code data includes an intermediate value C indicating a transient state at the time when the signal rises from a low level to a high level, and an intermediate value D indicating a transient state at the time when the signal falls from the high level to the low level.

Moreover, the intermediate value may be adapted also in the status of the low level or the high level so as to have a certain fluctuation also in the status of the low level or the high level.

By allowing the prediction code data to include the intermediate value indicating the transient state or the fluctuation, the prediction code data can be approximated to the actual received waveform data. More pertinent correlation value can be obtained by approximating the waveform shape more, and thereby the proper code can be acquired.

Next, a second embodiment of the present invention will be described.

In the first embodiment, the signal comparing circuit 18 calculates the covariance as the correlation value between the received waveform data and the first prediction code data, the second prediction code data and the third prediction code data respectively, and judges which of the codes the received waveform data corresponds to based on the covariance.

In the second embodiment, as the correlation value, a residual error which is the sum of absolute values of the differences is calculated, and the code corresponding to the predicted waveform data by which the residual error becomes minimum is specified.

Figure 10:
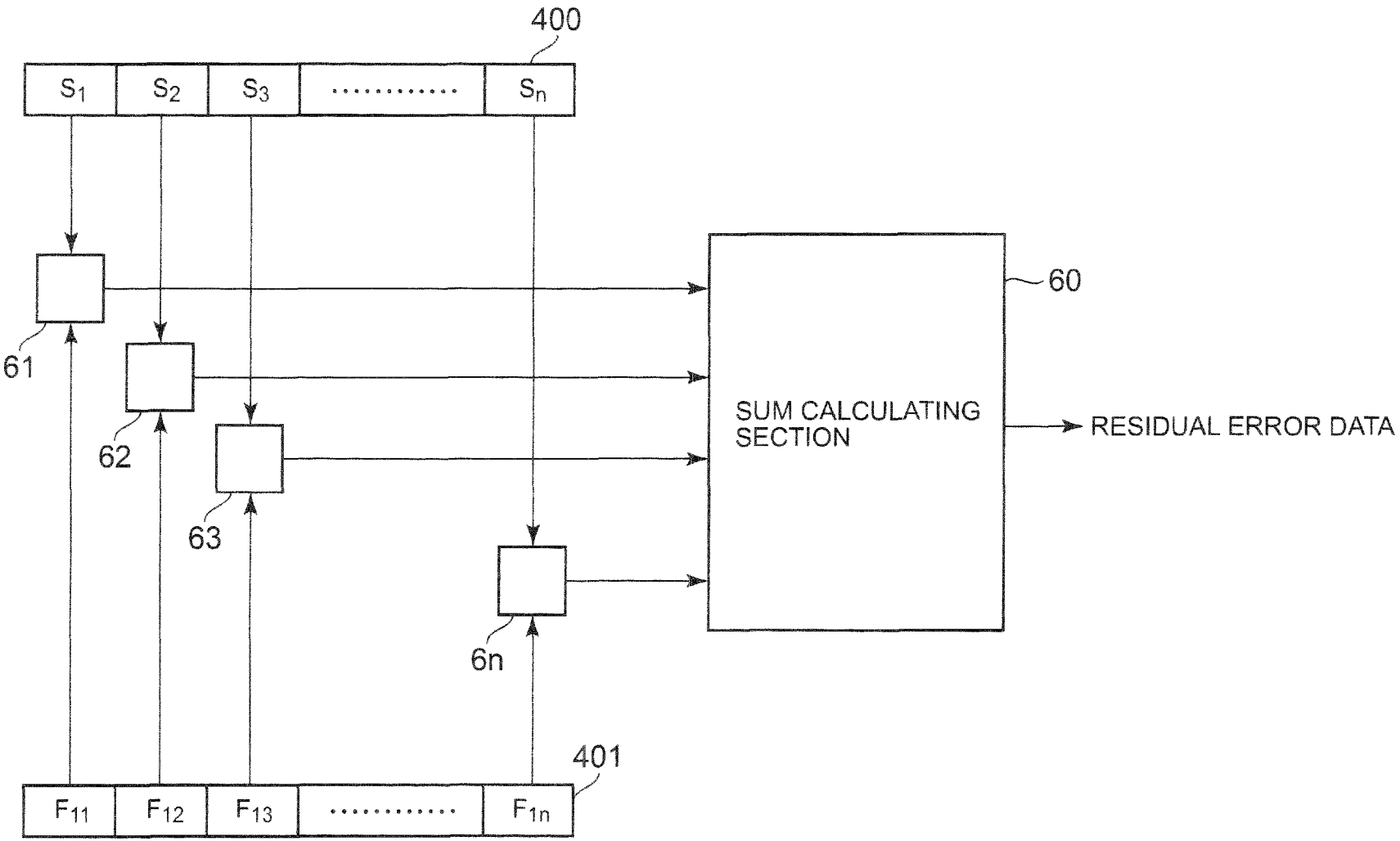
FIG. 10 is a block diagram showing details of the correlation value calculating section according to a second embodiment of the present invention.

FIG. 10 is a block diagram showing details of the correlation value calculating section according to the second embodiment. Similar to the case of the first embodiment, though only the first correlation value calculating section 24 will be explained with reference to FIG. 10, the second correlation value calculating section 25 and the third correlation value calculating section 26 have same configurations as that of the first correlation value calculating section 24.

As shown in FIG. 10, the first correlation value calculating section 24 according to the second embodiment includes: a plurality of adder-subtractors 61, 62, 63, **6*n* to calculate an absolute value of the difference between the sample of the received waveform data 400 and the corresponding sample of the first prediction code data; and a sum calculating section 60 to sum up outputs from the adder-subtractors 61, 62, 63, . . . , 6*n***.

Each of the adder-subtractors 61, 62, 63, . . . , **6*n* calculates an absolute value $|S_k-F_{1k}|$ (k=1, 2, . . . , n) of the difference between the sample of the received waveform data 400 and the corresponding sample of the first prediction code data 401. The sum calculating section 60** calculates the sum $R_1=\Sigma|S_k-F_{1k}|$ (k=1, 2, . . . , n) of the absolute values of the differences to output the obtained sum $R_1$ as the residual error.

The second embodiment shows that the smaller the value, the larger the correlation.

Therefore, the correlation value comparing section 27 compares the first correlation value (residual error data $R_1$), the second correlation value (residual error data $R_2$) and the third correlation value (residual error data $R_3$) which are respectively calculated by the first correlation value calculating section 24, the first correlation value calculating section 25 and the third correlation value calculating section 26, with one another, to specify the smallest correlation value. After that, the correlation value comparing section 27 specifies the prediction code data which has been a basis for the calculation of the smallest residual error data to output the code corresponding to the specified prediction code data as the determined code data corresponding to one (1) frame of the received waveform data which has been subjected to the processing.

According to the second embodiment, though there is an influence by amplitude or DC level of the received signal, the code can be determined quickly by an incredibly simple calculation.

Incidentally, in the second embodiment, each of the adder-subtractors 61-**6*n* calculates the absolute value $|S_k-F_{1k}|$ (k=1, 2, . . . , n) of the difference between the sample of the received waveform data 400 and the corresponding sample of the first prediction code data 401**.

Instead of the adder-subtractors 61-**6*n*, a square difference calculating circuit to calculate a square $|S_k-F_{1k}|^2$ (k=1, 2, . . . , n) of the difference between the sample of the received waveform data 400 and the corresponding sample of the first prediction code data 401** may be used. In this embodiment, a square residual error is obtained in so-called sum calculating section.

Next, the third embodiment of the present invention will be described.

In the third embodiment, a cross-correlation function is obtained instead of the covariance (the first embodiment) or the residual error (the second embodiment).

Figure 11:
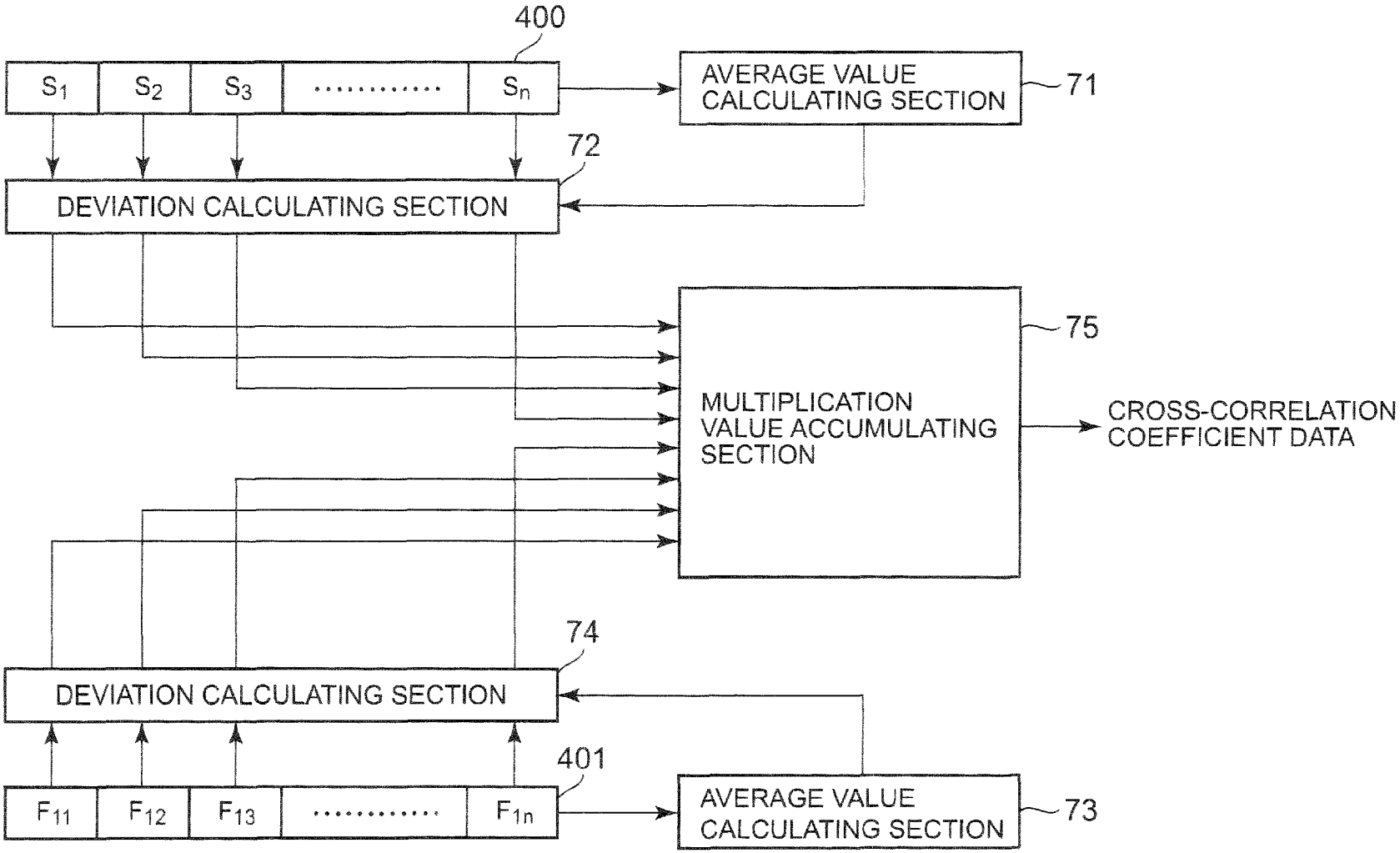
FIG. 11 is a block diagram showing details of the correlation value calculating section according to a third embodiment of the present invention.

FIG. 11 is a block diagram showing details of the correlation value calculating section according to the third embodiment. Similar to the first embodiment and the second embodiment, though only the first correlation value calculating section 24 will be explained with reference to FIG. 11, the second first correlation value calculating section 25 and the third first correlation value calculating section 26 have same configurations as that of the first correlation value calculating section 24.

As shown in FIG. 11, the first correlation value calculating section 24 includes: an average value calculating section 71 to calculate the average value of the samples of the received waveform data 400; a deviation calculating section 72 to calculate the deviation between each of the samples of the received waveform data 400 and the average value of the samples; an average value calculating section 73 to calculate the average value of the samples of the first prediction code data 401; a deviation calculating section 74 to calculate the deviation between each of the samples of the first prediction code data 401 and the average value of the samples; and a multiplication value accumulating section 75 to accumulate the normalized multiplication values of the corresponding deviations.

The deviation calculating section 72 outputs the following value $\phi$ (i) (i=1, 2, . . . , n).

$$\phi(i)=S_i-\Sigma S_i/n$$

Moreover, the deviation calculating section 74 outputs the following value $\psi_1$ (i) (i=1, 2, . . . , n).

$$\psi_1(i)=F_{1i}-\Sigma F_{1i}/n$$

The multiplication value accumulating section 75 calculates the following cross-correlation coefficient $C_1$ based on the above-described deviation to output the coefficient as the first correlation value.

$$C_1=(\Sigma\phi(i)\psi_1(i))/(\Sigma\phi(i)^2+\Sigma\psi_1(i)^2)^{1/2}$$

Also the second first correlation value calculating section 25 and the third first correlation value calculating section 26 respectively calculate cross-correlation coefficients $C_2$, $C_3$ to output them as the second correlation value and the third correlation value.

The correlation value comparing section 27 compares the first correlation value (the cross-correlation coefficient $C_1$), the second correlation value (the cross-correlation coefficient $C_2$) and the third correlation value (the cross-correlation coefficient $C_3$) respectively calculated by the first correlation value calculating section 24, the first correlation value calculating section 25 and the third correlation value calculating section 26, with one another, to specify the correlation value which is closest to one (1).

After that, the correlation value comparing section 27 outputs the code corresponding to the prediction code data which has been a basis for the calculation of the correlation value closest to one (1), as the determined code data corresponding to one (1) frame of the received waveform data which has been subjected to the processing.

In the third embodiment, the received waveform data and the prediction code data are normalized so that the correlation value is within the range from "−1" to "1". According to the third embodiment, the code can be obtained with high accuracy without depending on amplitude or a DC level of the received signal.

It is obvious that the present invention is not limited to those embodiments, various changes may be made without departing from the scope of the invention, and also such changes are included in the scope of the invention

What is claimed is:

1. A time acquisition apparatus comprising:

a receiving member to receive a standard time radio wave;

a received, waveform data obtaining member to perform sampling to a signal including a time code output from the receiving member with a predetermined sampling period to obtain one frame of received waveform data where each sample has a value represented by a plurality of bits;

a received waveform data memory to store the received waveform data;

a prediction code data generating member to generate one frame of first prediction code data corresponding to a code of a position marker or a marker, in which data each sample has a value represented by a plurality of bits, one frame of second prediction code data corresponding to a code "0", and one frame of third prediction code data corresponding to a code "1", a correlation value calculating member to compare the one frame of the received waveform data stored in the received waveform data memory with the first prediction code data, the second prediction code data and the third prediction code data respectively, to calculates a first correlation value, a second correlation value and a third correlation value which indicate correlations between the received waveform data and the first, second, and third prediction code data;

a code determining member to compare the first, second, and third correlation value with one another to specify the prediction code data corresponding to the largest correlation value, and to sequentially store codes corresponding to the specified prediction code data in a code memory; and a current time calculating member to calculate current time based on the time code indicated by the code, with reference to the code sequence stored in the code memory.

2. The time acquisition apparatus according to claim 1, wherein the correlation value calculating member comprises:

a first deviation calculating member to calculate a deviation between an average value of sample values of the received waveform data and each of the sample values of the received waveform data;

a second deviation calculating member to calculate a deviation between an average value of sample values of any of the first, second and third prediction code data and each of the sample values of any of the first, second and third prediction code data;

a multiplying member to multiply a first deviation output from the first deviation calculating member by a second deviation output from the second deviation calculating member; and an average value calculating member to calculate an average value of multiplication values output from the multiplying member.

3. The time acquisition apparatus according to claim 1, wherein the correlation value calculating member comprises:

a difference calculating member to calculate an absolute value or a square of a difference between a first sample value of the received waveform data and a sample value of any of the first, second and third prediction code data corresponding to the first sample value; and a summing member to sum up values output from the difference calculating member.

4. The time acquisition apparatus according to claim 1, wherein the correlation value calculating member comprises:

a first deviation calculating member to calculate a deviation between an average value of sample values of the received waveform data and each of the sample values of the received waveform data;

a second deviation calculating member to calculate a deviation between an average value of sample values of any of the first, second and third prediction code data and each of the sample values of any of the first, second and third prediction code data; and a sum calculating member to calculate a sum of normalized multiplication values between a first deviation output from the first deviation calculating member and a second deviation output from the second deviation calculating member, corresponding to the first deviation.

5. The time acquisition apparatus according to claim 1, wherein the prediction code data calculating member generates a prediction code data which includes a sample value as an intermediate value corresponding to a transient state between a low level and a high level.

6. A radio wave clock comprising:

the time acquisition apparatus according to claim 1;

an internal timekeeping member to keep current time by an internal clock;

a time correcting member to correct time kept by the internal timekeeping member according to current time acquired by the time acquisition apparatus; and a time displaying member to display the current time which is kept by the internal timekeeping member or corrected by the time correcting member.

7. A radio wave clock comprising:

the time acquisition apparatus according to claim 2;

an internal timekeeping member to keep current time by an internal clock;

a time correcting member to correct time kept by the internal timekeeping member according to current time acquired by the time acquisition apparatus; and a time displaying member to display the current time which is kept by the internal timekeeping member or corrected by the time correcting member.

8. A radio wave clock comprising:

the time acquisition apparatus according to claim 3;

an internal timekeeping member to keep current time by an internal clock;

a time correcting member to correct time kept by the internal timekeeping member according to current time acquired by the time acquisition apparatus; and a time displaying member to display the current time which is kept by the internal timekeeping member or corrected by the time correcting member.

9. A radio wave clock comprising:

the time acquisition apparatus according to claim 4;

an internal timekeeping member to keep current time by an internal clock;

a time correcting member to correct time kept by the internal timekeeping member according to current time acquired by the time acquisition apparatus; and a time displaying member to display the current time which is kept by the internal timekeeping member or corrected by the time correcting member.

10. A radio wave clock comprising:

the time acquisition apparatus according to claim 5;

an internal timekeeping member to keep current time by an internal clock;

a time correcting member to correct time kept by the internal timekeeping member according to current time acquired by the time acquisition apparatus; and a time displaying member to display the current time which is kept by the internal timekeeping member or corrected by the time correcting member.

* * * * *